US006615719B1

(12) United States Patent
Winston

(10) Patent No.: US 6,615,719 B1
(45) Date of Patent: Sep. 9, 2003

(54) MULTI-FUNCTION INKING TOOLS

(76) Inventor: Jeffrey M. Winston, 658 W. Shore Dr., Anacortes, WA (US) 98221

( * ) Notice: Subject to any disclaimer, the term of this patent is extended or adjusted under 35 U.S.C. 154(b) by 0 days.

(21) Appl. No.: 09/973,856

(22) Filed: Oct. 9, 2001

Related U.S. Application Data

(60) Provisional application No. 60/239,431, filed on Oct. 10, 2000.

(51) Int. Cl.[7] ..... B41K 1/00; B41K 1/04; B41K 1/22; B41K 1/56

(52) U.S. Cl. ..... 101/327; 101/328; 101/333; 101/405; 101/406

(58) Field of Search ..... 101/405, 406, 101/327, 328, 333

(56) References Cited

U.S. PATENT DOCUMENTS 1,297,217 A * 3/1919 Mendell ..... 33/41.1
2,252,649 A * 8/1941 Smallman ..... 101/333
3,465,673 A * 9/1969 Oppenheim ..... 101/328
4,452,142 A * 6/1984 Eckels ..... 101/368
4,676,162 A * 6/1987 Phipps et al. ..... 101/405
4,817,526 A 4/1989 Winston
5,359,932 A * 11/1994 Van Breene ..... 101/334
5,435,245 A * 7/1995 Salisbury et al. ..... 101/328
5,738,011 A * 4/1998 Tay ..... 101/368
5,816,160 A * 10/1998 Taira et al. ..... 101/405

FOREIGN PATENT DOCUMENTS

GB 2084081 A * 4/1982

* cited by examiner

*Primary Examiner*—Daniel J. Colilla
*Assistant Examiner*—Jill E Culler
(74) *Attorney, Agent, or Firm*—Michael R. Schacht; Schacht Law Office, Inc.

(57) ABSTRACT

An inking system for applying ink to an inking surface. The inking system comprises a handle, a first and second intermediate members, and first and second inking assemblies. The intermediate members attach the first and second intermediate members to the handle so that a user has two inking surfaces to use. The first and second inking assemblies can be of different types.

9 Claims, 4 Drawing Sheets

MULTI-FUNCTION INKING TOOLS

RELATED APPLICATIONS

This application claims priority of U.S. Provisional Application Serial No. 60/239,431 filed Sep. 10, 2000.

FIELD OF THE INVENTION

The present invention relates to systems and methods for forming ink impressions on paper and, more specifically, to such systems and methods for applying ink from an absorbent pad to an inking surface to be inked.

BACKGROUND OF THE INVENTION

The present invention relates ink stamping systems and methods in which an ink impression is formed on an impression carrying member that forms a stamping surface. The ink is applied to a stamp member on which a design is formed in bas relief. The stamp member with ink thereon is brought into contact with the carrying member such that ink is transferred to the stamping surface of the carrying member to form an ink impression in a configuration corresponding to the design on the stamp member.

The present invention is of particular importance in the formation of artistic rather than commercial ink impressions. Ink stamping systems for use by art stampers are designed and constructed primarily to obtain a high quality ink impression, with flexibility of use also being of importance. Considerations such as repeatability of the ink impression, ease of use. and durability of the stamping devices are of lesser importance than in the commercial ink stamping environment. Art stamping uses the same basic ink stamping process as commercial ink stamping but has evolved to allow much finer control over the details and quality of the resulting ink impression. The principles of the present invention also have application to commercial ink stamping, however.

The present invention specifically relates to the application of ink from an inking member to what will be referred to as an inking surface. The inking surface may be the surface of an impression carrying member such as a sheet of paper or the stamping surface of a stamp member. If the inking surface is formed by the impression carrying member, the ink impression is directly formed by the inking member. If the inking surface is formed by a stamp member, ink is applied first to a stamp member and the stamp member is brought into contact with the impression carrying member to form the ink impression.

The inking member may be formed by a number of structures. For example, the inking member can be formed by an ink-impregnated inking pad or wheel, depending upon whether the ink is to be transferred to the inking surface in a discrete portion or a continuous band. Alternatively, the inking member may be in the form of a planar or cylindrical rubber stamp or stamping wheel.

More specifically, inking members may be formed by conventional rubber stamps in both planar form and in a cylindrical wheel for the formation of continuous images. Inking members have also long been sold in the form of ink-impregnated absorbent pads having a planar pad surface. A product available from the assignee of the present invention under the trademark COLOR TOOLBOX contains a stylus assembly comprising a handle with detachable ink pad tips. Inking wheels have long been used as part of inking assemblies that form a continuous, repeated ink image.

The need exists for improved, cost effective methods of handling inking members such as rubber stamps and ink-impregnated absorbent pads.

SUMMARY OF THE INVENTION

The present invention may be embodied as a system for applying ink to an inking surface. The system comprises a handle, at least one intermediate member, and an inking assembly. The inking assembly comprises a support member and an inking member. The intermediate member is attached to the handle, and the support member attaches the inking member to the intermediate member. The handle is displaced to bring the inking member into contact with the inking surface to transfer ink from the inking member to the inking surface.

The inking member can be in the form of a flat pad or a wheel. The intermediate member will be same regardless of the form of the inking member, but the support member is specifically adapted to support either a flat pad or a wheel.

DETAILED DESCRIPTION OF THE PREFERRED EMBODIMENTS

Figure 1:
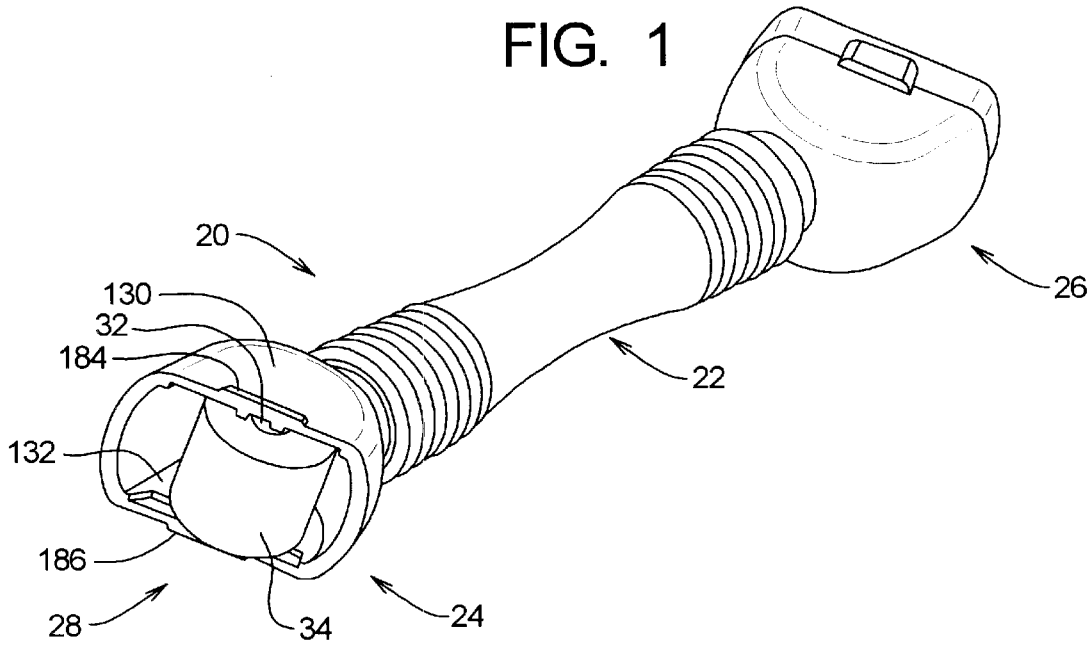
FIG. 1 is a perspective view depicting a first end of an inking assembly of the present invention.
Figure 2:
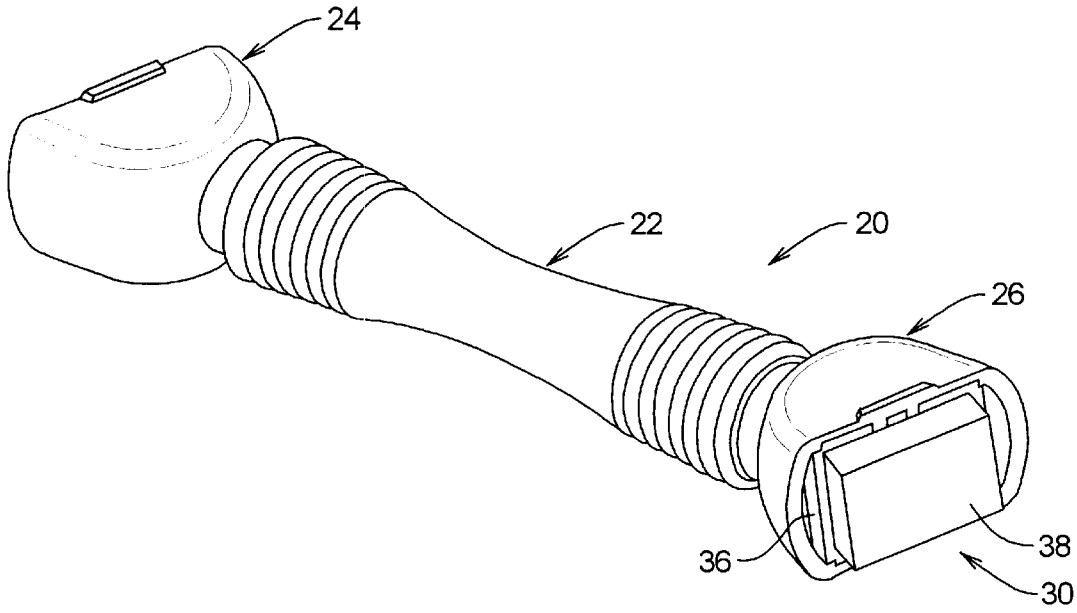
FIG. 2 is a perspective view of a second end of the inking assembly depicted in FIG. 1.

Referring initially to FIGS. 1 and 2, depicted at 20 therein is an inking system constructed in accordance with, and embodying, the principles of the present invention. As perhaps best shown in FIG. 3, the exemplary inking system 20 comprises a handle 22, first and second intermediate members 24 and 26, and first and second inking assemblies 28 (FIG. 1) and 30 (FIG. 2). The first inking assembly 28 comprises a first support member 32 and a first inking member 34, while the second inking assembly 30 comprises a second support member 36 and a second inking member 38.

Figure 4:
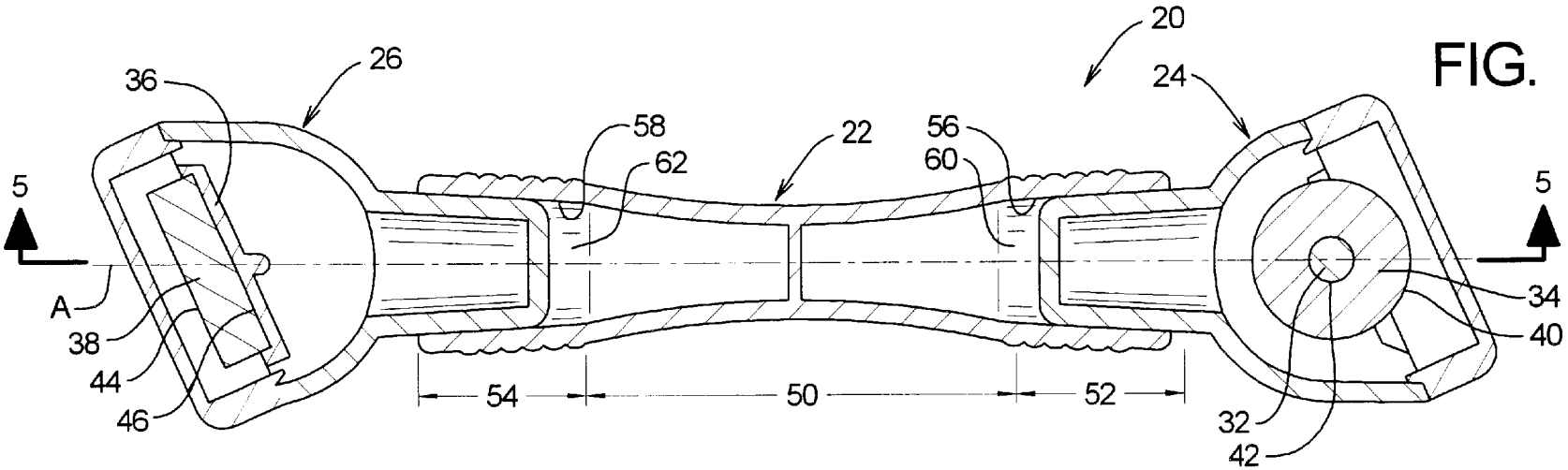
FIG. 4 is a side elevation section view of the inking assembly of FIG. 1.
Figure 6:
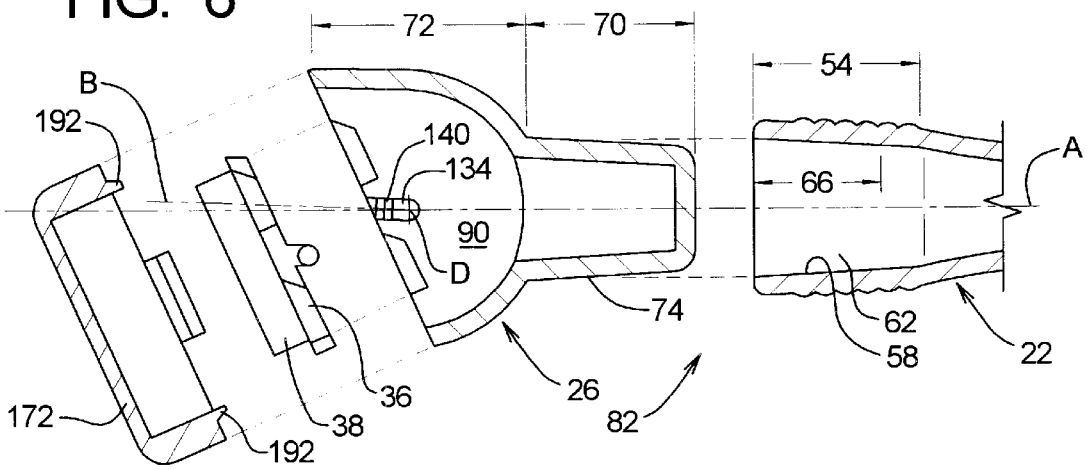
FIG. 6 is an exploded section view of the second end of the inking assembly depicted in FIG. 2.
Figure 7:
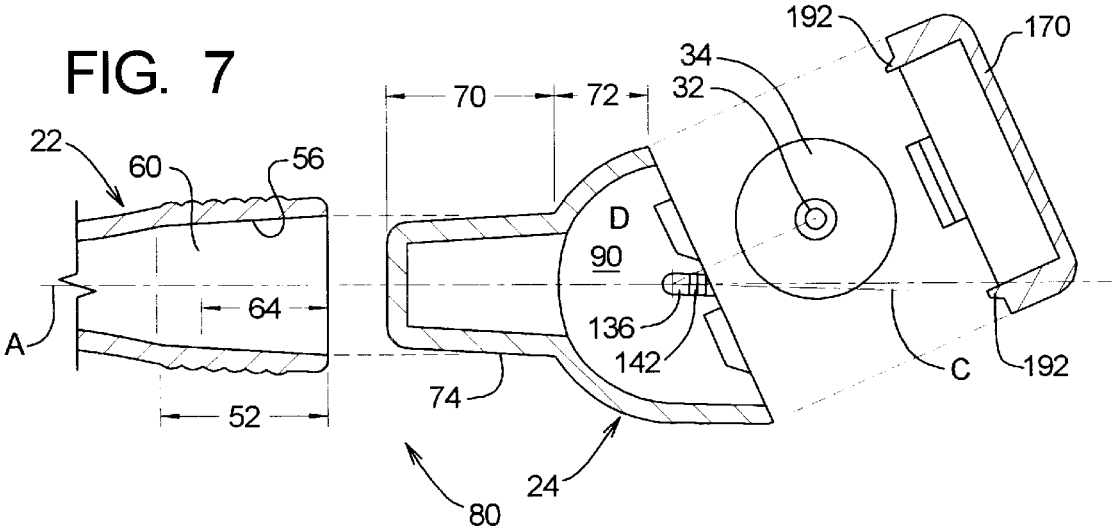
FIG. 7 is an exploded section view of the first end of the inking assembly as depicted in FIG. 1.

In the exemplary system 20, the first inking member 34 is, as shown in FIG. 4 and 7, a cylindrical inking wheel defining a wheel surface 40 and an axle hole 42, and the first support member 32 is an axle member that extends through the axle hole 42. And as shown in FIGS. 4 and 6, the exemplary second inking member 38 is a flat inking pad defining a pad surface 44; the exemplary second support member 36 is formed by a support plate defining a support cavity 46 that receives a portion of the inking member 38.

Figure 3:
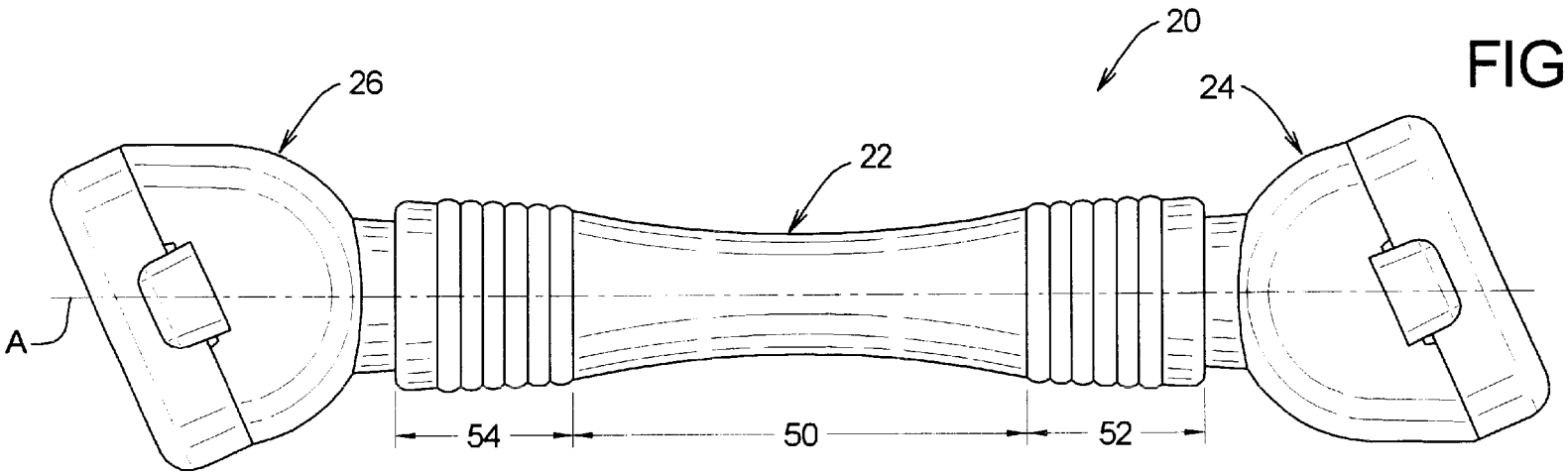
FIG. 3 is a side elevation view of the inking assembly of FIG. 1 with half of a housing assembly removed.
Figure 5:
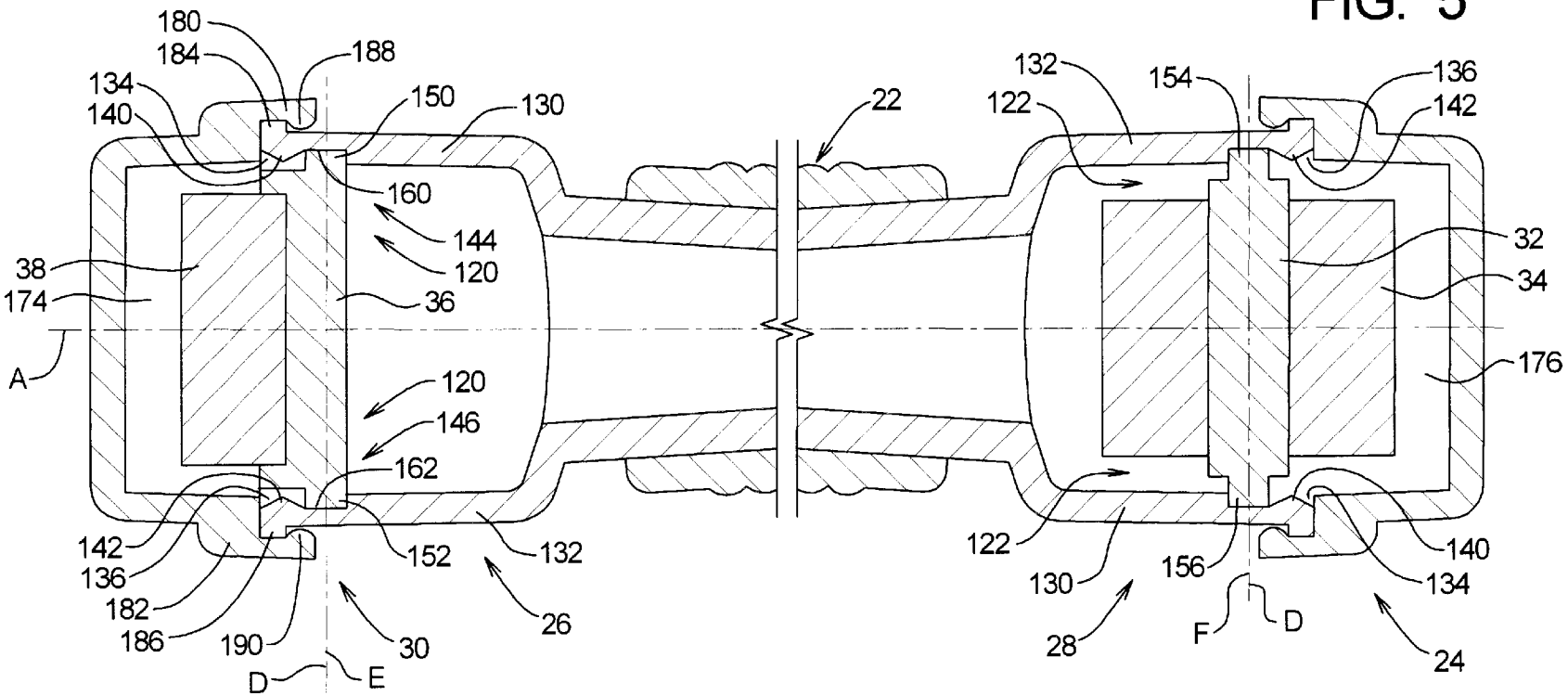
FIG. 5 is a section view of the inking assembly of FIG. 1 taken along lines 5—5 in FIG. 4.

As shown in FIGS. 3, 4, and 5, the exemplary handle 22 comprises a handle shaft portion 50 and first and second socket portions 52 and 54. As perhaps best shown in FIGS. 4, 6, and 7, the socket portions 52 and 54 comprises socket surfaces 56 and 58 that define sockets 60 and 62. The socket surfaces 56 and 58 are tapered and define frustoconical engaging portions 64 and 66; the engaging portions 64 and 66 form a friction fit with the intermediate members 24 and 26 as will be described below.

The exemplary handle 22 defines a longitudinal axis A and is symmetrical about this axis A. The symmetrical shape renders the handle 22 easy to manufactured and use. Other shapes and configurations of the handle 22 are possible, however, and it is not necessary that the handle be symmetrical about its longitudinal or any other axis in other embodiments of the present invention. For example, a handle constructed in accordance with the principles of the present invention may be fabricated with only one socket portion.

As perhaps best shown in FIGS. 6 and 7, the exemplary intermediate members 24 and 26 each comprise a mounting portion 70 and a hood portion 72. The mounting portions 70 are sized and dimensioned to extend at least partly into the sockets 60 and 62 and engage the engaging portions 64 and 66 of the socket surfaces 56 and 58. The engagement of the mounting portions 70 with the engaging portions 64 and 66 inhibits incidental movement of the intermediate members 24 and 26 relative to the handle 22. The exemplary mounting portions 70 comprise mounting surfaces 74 that are generally frustoconical, but the mounting portions 70 may be in any shape that creates sufficient friction to inhibit relative movement between the intermediate members 24 and 26 and the handle 22.

The mounting portions 70 of the intermediate members 24 and 26 and sockets 60 and 62 thus form first and second mounting systems 80 and 82 that inhibit incidental movement between the handle 22 and the intermediate members 24 and 26. The mounting systems 80 and 82 allow the intermediate members 24 and 26 to be removed from the handle 22 with the deliberate application of manual force. In other configurations of the present invention, a detent-type mounting system that positively locks the intermediate members 24 and 26 to the handle 22 may be used in conjunction with or in place of the friction fit mounting systems 80 and 82 described above.

The hood portions 72 of the exemplary intermediate members 24 and 26 define hood cavities 90 that, in use, contain a portion of the inking assemblies 28 and 30. In the preferred form of the inking system 20, only a portion of the inking assemblies 28 and 30 extends from the hood cavities 80 to allow the inking members 34 and 38 to be brought into contact with the inking surface. The portion of the inking assemblies 28 and 30 that does not extend from the hood cavities 80 is protected by the hood portions 72. The hood portions 72 thus inhibit damage or disassembly of the system 20 if dropped and also reduce the likelihood that the user will come into contact with the ink on the inking members 34 and 38 during application of ink to the inking surface. The hood portions 72 are preferred but not necessary to practice the present invention in its broadest form.

In the exemplary inking system 20, the intermediate members 24 and 26 are identical. Making the intermediate members identical is preferred because manufacturing and inventory control are simplified, but identical intermediate members are not essential to practice the present invention in its broadest form.

Referring now to FIGS. 5–7, depicted therein are first and second attachment systems 120 and 122 that allow the support members 32 and 36 to be detachably attached to the intermediate members 24 and 26.

In particular, the hood portions 72 of the exemplary intermediate members 24 and 26 comprise first and second bearing walls 130 and 132. First and second bearing slots 134 and 136 are formed in the bearing walls 130 and 132, respectively. First and second locking projections 140 and 142 are formed in the slots 134 and 136, respectively. The bearing slots 134 and 136 define a slot axes B and C and a mounting axis D that intersects the slot axes B and C. The mounting axis D defines a locking position at closed ends 144 and 146 of the slots 134 and 136, respectively. During use of the system 20, the axes B and C of the exemplary slots 134 and 136 are substantially parallel to the longitudinal axis A defined by the handle 22.

The support members 32 and 36 have different shapes and configurations but each comprises a pair of bearing portions: the first support member 32 comprises first and second bearing portions 150 and 152, and the second support member 36 comprises first and second bearing portions 154 and 156. The pairs of first and second bearing portions 150,152 and 154,156 define bearing axes E and F, respectively. The bearing portions 150 and 152 are spaced along the bearing axis E a distance equal to the distance between the bearing portions 154 and 156 along the bearing axis F.

In addition, the closed ends 144 and 146 of the first and second bearing slots 134 and 136 are spaced from each other along the mounting axis D a distance substantially the same as the distance between the bearing portions 150,152 and 154,156 along the bearing axes E and F. More specifically, bearing surfaces 160 and 162 that define the slots 134 and 136 are formed on the bearing walls 130 and 132. The distance between these surfaces 160 and 162 is slightly greater than the distance between the bearing portions 150,152, and 154,156 along the bearing axes E and F. The bearing portions 150,152 and 154,156 thus fit into the bearing slots 134 and 136 with the bearing axes E and F aligned with the mounting axis D as shown in FIG. 5.

To retain the bearing portions 150,152 and 154,156 within the bearing slots 134 and 136, and thus detachably attach the support members 32 and 36 to one of the intermediate members 24 or 26, the locking projections 140 and 142 are formed on the bearing surfaces 160 and 162. The locking projections 140 and 142 are triangular in cross-section and are arranged such that the bearing portions 150,152 and 154,156 must travel over the locking projections 140 and 142 to reach the slot ends 144 and 146.

Because the locking projections 140 and 142 are triangular in cross-section and the hood portions 72 are somewhat flexible, the bearing portions 150,152 and 154,156 are able to travel over the locking projections 140 and 142 in either direction with the deliberate application of manual force. However, the locking projections 140 and 142 will inhibit movement of the bearing portions 150,152 and 154,156 out of the slot ends 144 and 146.

The locking projections 140 and 142 thus reduce the likelihood that the support members will be inadvertently detached from the intermediate members but allow the support members to be manually detached when desired.

Referring now to FIGS. 5–7, it can be seen that the exemplary inking system 20 further comprises first and second cap members 170 and 172. The cap members 170 and 172 are sized and dimensioned to engage the hood portions 72 of the intermediate members 24 and 26 to form closed hood chambers 174 and 176.

In particular, first and second attachment ears 180 and 182 extending from each of the cap members 170 and 172 engage first and second attachment projections 184 and 186 formed in the bearing walls 130 and 132, respectively, of the hood portions 72. Ear projections 188 and 190 extend from the attachment ears 180 and 182 to positively lock the cap members 170 and 172 onto the hood portions 72. At least one alignment projection 192 extends from the exemplary cap members 170 and 172 to ensure that the cap members 170 and 172 properly engage the hood portions 72 to form the hood chambers 174 and 176.

The cap members 170 and 172 are not essential to protect the inking members 34 and 38 when the system 20, or one end thereof, is not in use.

With the foregoing understanding of the basic operation of the system 20 in mind, the flexibility that this system 20 provides during manufacture, sales, and use will now be described in the context of the method of using the system 20.

Initially, it should be noted that the inking system of the present invention is modular and may be embodied in a wide variety of different configurations. For example, the exemplary inking system 20 described herein comprised ink-impregnated absorbent pads, one arranged in a cylinder (the inking member 34) and one arranged in a plane (the inking member 38).

Other inking members in other configurations may be employed, however. As one alternative, one or more of the inking members may be a rubber stamp member arranged in a cylindrical or planar arrangement. The inking member may also be a more traditional pen shaped inking member such as is commonly found on a felt-tip pen.

The type and configuration of the inking member will dictate the shape and configuration of the support member, but the intermediate member may be the same for any shape or configuration of the support member as long as the support member defines bearing portions that engage the intermediate members as described above. Similarly, the shape of the intermediate member may vary significantly as long as it defines a mounting portion adapted to engage the handle as described above. And the handle portion may be any ergonomically desirable shape that spaces the intermediate members a comfortable distance from each other.

The exact size, shape, and configuration of the handle, intermediate members, support members, bearing portions, and connections between these parts is thus not important to implementing the present invention as long as the parts can be combined as shown. The handle, intermediate members, and support members of the exemplary system 20 are made of injection molded plastic, but other materials and manufacturing techniques may be used.

The exemplary system 20 takes advantage of the fact that the handle has two ends to allow two inking assemblies 28 and 30 to be used. However, the present invention may embodied with a handle and only one inking assembly.

Once the user has connected the appropriate inking assembly to the handle, the handle is used in a generally conventional manner to manipulate the inking assembly to apply ink to the surface to be inked. If the inking assembly includes an inking member comprised of an ink-impregnated absorbent pad, the inking member is brought into contact with an inking surface such as a sheet of paper or a rubber stamp for transfer to another surface. If the inking member is a rubber stamp, the inking member will normally be brought into contact with an inking surface such as a sheet of paper or the like.

A different color of ink or a different rubber stamp can be used in several different manners. First, the old inking assembly may be removed from the intermediate member and the old inking member removed from the existing support member. A new inking member may then be combined with the existing support member to form a new inking assembly. The new inking assembly is then attached to the intermediate member and used as desired.

As an alternative, the user may stock an extra support member in addition to an extra inking member. In this case, the inking assembly need not be disassembled and the new inking member placed onto the existing support member. Instead, the extra inking member and support member are simply attached to the existing intermediate member.

Yet another alternative is for the user to stock an intermediate member dedicated to each color or rubber stamp. Then the inking assembly need not be detached from the intermediate member; instead, the intermediate member is removed from the handle and the extra intermediate member containing the new inking assembly is attached to the handle.

The system of the present invention also provides the manufacturer and retailer with significant flexibility in managing inventory. The plastic parts need not be duplicated for each of the different colors manufactured.

From the foregoing, it should be apparent that the present invention may be embodied in many different combinations and sub-combinations of the elements and steps described above. The scope of the present invention should thus be determined by the following claims and not the foregoing detailed description.

I claim:

1. An inking system for applying ink to an inking surface, comprising:

a handle defining a handle axis and comprising first and second socket surfaces, where the first and second socket surfaces are spaced along the handle axis on opposite ends of the handle;

a first intermediate member comprising a first mounting portion sized and dimensioned to frictionally engage the socket surfaces to detachably attach the first intermediate member to the handle, and a first hood portion defining first and second bearing slots, where first and second locking projections are arranged in the first and second bearing slots, respectively;

a second intermediate member comprising a second mounting portion sized and dimensioned to frictionally engage the socket surfaces to detachably attach the second intermediate member to the handle, and a second hood portion defining third and fourth bearing slots, where third and fourth locking projections are arranged in the third and fourth bearing slots, respectively;

a first inking assembly comprising a substantially planar first support member comprising first and second bearing portions, and a substantially planar first inking member secured to the first support member; and a second inking assembly comprising a substantially cylindrical second support member comprising third and fourth bearing portions and defining a mounting axis, and a substantially cylindrical second inking member, where the second support member extends through the second inking member; whereby the first mounting portion is received by the first socket surface to secure the first intermediate member to the handle;

the second mounting portion is received by the second socket surface to secure the second intermediate member to the handle;

the first and second bearing portions on the first support member are held within the first and second bearing slots by the first and second locking projections to secure the first inking assembly to the first intermediate member such that the first inking member maintains a predetermined relationship to the handle axis;

the third and fourth bearing portions on the second support member are held within the third and fourth bearing slots by the third and fourth locking projections to secure the second inking assembly to the second intermediate member such that the second inking member rotates about the mounting axis relative to the intermediate member.

2. An inking system as recited in claim 1, in which the first and second hood portions are adapted to enclose a portion of the first and second inking assemblies, respectively.

3. An inking system as recited in claim 1, in which:

the first intermediate member comprises first and second bearing walls defining the first and second bearing slots, respectively; and the first and second bearing portions are spaced from each other to be received by the respective first and second bearing slots and supported by the respective first and second bearing walls to detachably attach the first inking assembly to the first intermediate member.

4. An inking system as recited in claim 1, in which the first inking member is a rubber stamp.

5. An inking system as recited in claim 1, in which the first inking member is an ink-impregnated absorbent pad.

6. An inking system as recited in claim 1, in which the first support member is a support plate adapted to be secured to the first inking member.

7. An inking system as recited in claim 1, in which the second support member is an axle member adapted to extend through at least a portion of the second inking member to allow the second inking member to rotate about the mounting axis relative to the intermediate member.

8. An inking system as recited in claim 1, in which:

the second intermediate member comprises third and fourth bearing walls defining the third and fourth bearing slots, respectively; and the third and fourth bearing portions are spaced from each other to be received by the respective third and fourth bearing slots and supported by the respective third and fourth bearing walls to detachably attach the second inking assembly to the second intermediate member.

9. A method of applying ink to an inking surface, comprising the steps of:

providing a handle defining first and second socket surfaces;

providing a first intermediate member defining a first hood portion and a first mounting portion;

providing a second intermediate member defining a second hood portion and a second mounting portion;

detachably attaching the first intermediate member to the handle by frictionally engaging the first mounting portion and the first socket surface;

detachably attaching the second intermediate member to the handle by frictionally engaging the second mounting portion and the second socket surface;

forming first and second bearing slots in the first hood portion;

forming third and fourth bearing slots in the second hood portion;

forming first and second locking projections in the first and second bearing slots, respectively;

forming third and fourth locking projections in the third and fourth bearing slots, respectively;

providing a substantially planar first support member defining first and second bearing portions;

providing a substantially cylindrical second support member defining third and fourth bearing portions;

forming a first inking assembly by securing a substantially planar first inking member to the first support member;

forming a second inking assembly by securing a substantially cylindrical second inking member to the second support member;

detachably attaching the first inking assembly to the first intermediate member such that the first inking member is in a fixed relationship to the handle by arranging the first and second bearing portions within the respective first and second bearing slots such that the first and second locking projections inhibit inadvertent removal of the first and second bearing portions from the respective first and second bearing slots; and detachably attaching the second inking assembly to the second intermediate member such that the second inking member rotates about a mounting axis relative to the handle by arranging the third and fourth bearing portions within the respective third and fourth bearing slots such that the third and fourth locking projections inhibit inadvertent removal of the third and fourth bearing portions from the respective third and fourth bearing slots.

* * * * *